US005422660A

United States Patent [19]

Oikawa

[11] Patent Number: 5,422,660

[45] Date of Patent: Jun. 6, 1995

[54] THERMAL PRINTER WITH PRINT HEAD SUPPORT DEVICE

[75] Inventor: Tadahisa Oikawa, Tokyo, Japan

[73] Assignee: Kabushiki Kaisha Sato, Shibuya, Japan

[21] Appl. No.: 742,851

[22] Filed: Aug. 8, 1991

[30] Foreign Application Priority Data

Aug. 10, 1990 [JP] Japan ..... 2-213358

[51] Int. Cl.[6] ..... B41J 25/304; B41J 2/32

[52] U.S. Cl. ..... 347/198; 400/124.14

[58] Field of Search ..... 400/55, 56, 57, 120 HE, 400/120; 346/76 PH, 145

[56] References Cited

U.S. PATENT DOCUMENTS 4,507,666 3/1985 Kondo et al. ..... 400/120
5,023,628 6/1991 Koch ..... 346/145
5,064,300 11/1991 Kashiwaba ..... 400/56

FOREIGN PATENT DOCUMENTS 0080064 4/1987 Japan ..... 400/120 HE
0164572 7/1987 Japan ..... 400/120 HE

OTHER PUBLICATIONS

Perry, "Thermal Print Head Control", IBM Bulletin, vol. 21, No. 4, Sep. 1978, pp. 1594–1595.

*Primary Examiner*—Huan H. Tran
*Attorney, Agent, or Firm*—Ostrolenk, Faber, Gerb & Soffen

[57] ABSTRACT

A thermal printer print head support device allows the position of the thermal print head printing element to be shifted to the front or the rear relative to the platen axis. Thereby the printing pressure is varied and the print quality is optimized by matching the printing pressure to the different properties, such as thickness and hardness, of the printing media (tags, labels. etc.).

16 Claims, 8 Drawing Sheets

THERMAL PRINTER WITH PRINT HEAD SUPPORT DEVICE

BACKGROUND OF THE INVENTION

This invention relates to a print head support device for a thermal printer.

DESCRIPTION OF THE BACKGROUND ART

Prices and other merchandise related information are printed in bar-code format or the like on printing medium such as on labels, tags, etc. Typically, the printing medium is passed between a platen and a thermal print head, the print head being pressed against the platen with a prescribed pressure.

The different types of printing media being used, such as labels or tags for example, differ in their thickness, hardness and other characteristics which affect the print quality. This makes it impossible to provide a single optimal relative positioning of the thermal print head and the platen which could best suit the needs arising from the different printing media. The problem can be appreciated from the following.

When the platen is at rest, the only force acting on the print head printing element is the force pressing the head against the platen. However, when the platen is rotating the print head printing element is subjected to a tangential force "f" in the direction of platen rotation. This force "f" influences the printing pressure and hence the print quality. The explanation is that the platen elastically deforms from the pressure of the print head, the degree of the deformation depending on the characteristics of the print media. For example, tags are relatively hard and labels are relatively soft. Therefore, the platen is deformed to a lesser degree when a tag is being printed and to a greater extent when the print media is a label.

The effect of the different degrees of deformation is that the force "f" acting on the print head printing element in the direction of platen rotation, that is, the printing pressure, differs based on whether a tag or a label is being printed. This results in variations in print quality between tags and labels.

SUMMARY OF THE INVENTION

It is an object of the present invention to provide a thermal printer print head support device that allows shifting of the position of the thermal print head printing element either to the front, in the direction of platen rotation, or backwards relative to the platen, to compensate for differences in print media properties such as thickness and hardness. Thereby, an optimal print quality is obtained for each print medium.

To attain the above and other objects, the present invention comprises an arrangement whereby the position on the platen at which the thermal print head printing element presses is adjusted forward or backward relative to the axis of rotation of the platen depending on the type of printing media being printed.

With the thermal printer print head support device according to this invention, when printing on a medium such as a label that has a relatively low stiffness, the printing pressure is optimized for that medium by locating the position at which the thermal print head printing element presses against the platen backward relative to the axis of platen rotation. Conversely, when printing on a medium that has a relatively high stiffness, such as a tag, the printing pressure is optimized by shifting the thermal print head position forward relative to the axis of platen rotation.

Other features and advantages of the present invention will become apparent from the following description of the invention which refers to the accompanying drawings.

BRIEF DESCRIPTION OF THE DRAWINGS

FIG. 8(*b*) is a plan view of the head pressing members.

FIG. 8(*c*) is a front view of the head pressing member.

FIG. 10(*b*) is a cross-sectional side view through line A—A of FIG. 10(*a*).

FIG. 11(*b*) is a side view of the rotatable positioning member.

FIG. 12(*b*) shows the underside of the head mounting bracket with the rotatable positioning member with the other cutout side located on the rear edge of the head bracket.

FIG. 13(*b*) shows the underside of the thermal print head.

FIG. 13(*c*) is a rear view of the thermal print head.

FIG. 13(*d*) is a side view of the thermal print head.

FIG. 14(*b*) is a side view of the upper connector support bracket.

FIG. 14(*c*) is a plan view of the lower connector support bracket.

FIG. 14(*d*) is a side view of the lower connector support bracket.

DETAILED DESCRIPTION OF THE DRAWINGS

Several embodiments of the invention will now be described with reference to the drawings. The present invention is based on the discovery, as illustrated in FIGS. 1 to 6, that the position of the printing element 2 of a thermal print head 1 relative to the platen 3 has an effect on the printing quality obtained when information is imprinted on the printing medium 4.

Figure 1:
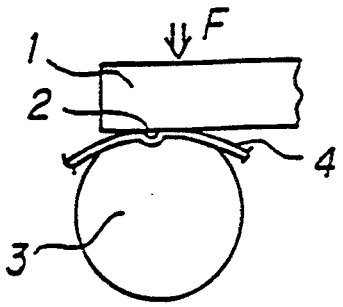
FIG. 1 diagrammatically illustrates the printing pressure when the platen is at rest, in accordance with the present invention.
Figure 2:
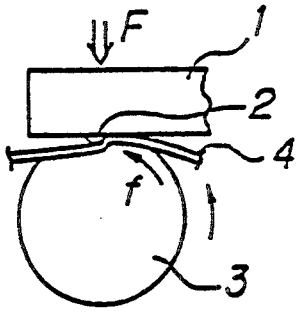
FIG. 2 illustrates the printing pressure when the platen is rotating.

FIG. 1 shows the thermal print head 1 pressing against the platen 3 via the intervening printing medium 4. While the platen 3 is at rest, the only force being exerted on the printing element 2 is the pressing force F of the thermal print head 1. When the platen 3 is rotated in the direction indicated by the arrow in FIG. 2, the printing element 2 is subjected to the force "f" in the direction of rotation of the platen 3. This force "f" affects the printing pressure and influences the quality of printing on the printing medium 4.

Figure 3:
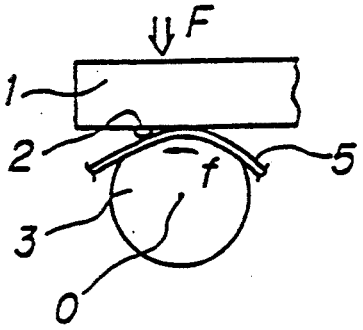
FIG. 3 illustrates the printing pressure when the printing element is positioned toward the front of the platen.
Figure 4:
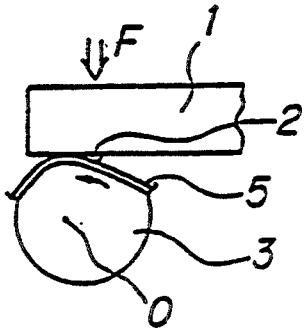
FIG. 4 illustrates the printing pressure when the printing element is positioned toward the rear of the platen.

Printing on a tag is now explained with reference to FIGS. 3 and 4. Because a tag 5 is relatively hard and thick, the pressing force F of the thermal print head 1 does not produce appreciable elastic deformation of the platen 3. In this case, having the printing element 2 located forward of the center of rotation O of the platen 3, as shown in FIG. 3, i.e. forwards in the direction of platen rotation, increases the printing pressure "f" and produces good quality printing. Conversely, having the printing element 2 located behind the center of rotation O, as shown in FIG. 4, decreases the printing pressure "f" and degrades the printing quality.

Figure 5:
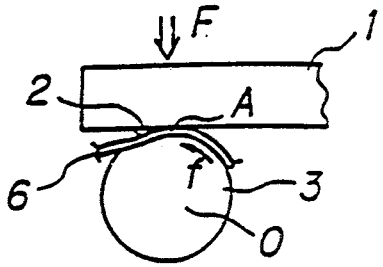
FIG. 5 illustrates the printing pressure when the printing element is positioned toward the front of the platen while printing a label.
Figure 6:
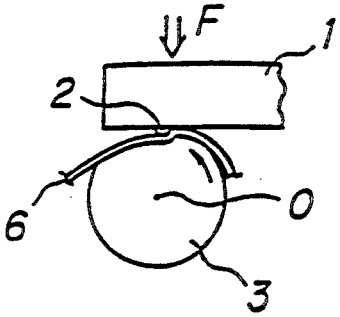
FIG. 6 illustrates the printing pressure when the printing element is positioned toward the rear of the platen while printing a label.

The effects of printing on a label 6 is explained with reference to FIGS. 5 and 6. Because the label 6 is relatively soft and thin, the pressing force F of the thermal print head 1 produces a relatively large elastic deformation of the platen 3. Having the printing element 2 located forward of the center of rotation O, as shown in FIG. 5, decreases the printing pressure "f", and therefore reduces the printing quality. This is because a larger area of contact A is produced between the lower part of the thermal print head 1 and the platen 3. Conversely, having the printing element 2 located behind the center of rotation O, as shown in FIG. 6, increases the printing pressure "f" and therefore improves the quality of printing.

Thus, when the printing medium 4 is relatively hard or stiff as the tag 5, the printing quality is improved by keeping the printing element 2 of the thermal print head 1 positioned forward of the axis of the platen 3, whereas when the printing medium 4 is relatively soft or flexible as the label 6, the printing quality is improved by printing with the printing element 2 positioned behind the platen 3 axis.

A thermal printing print head support device according to the present invention will now be described with reference to FIGS. 7 to 14.

Figure 7:
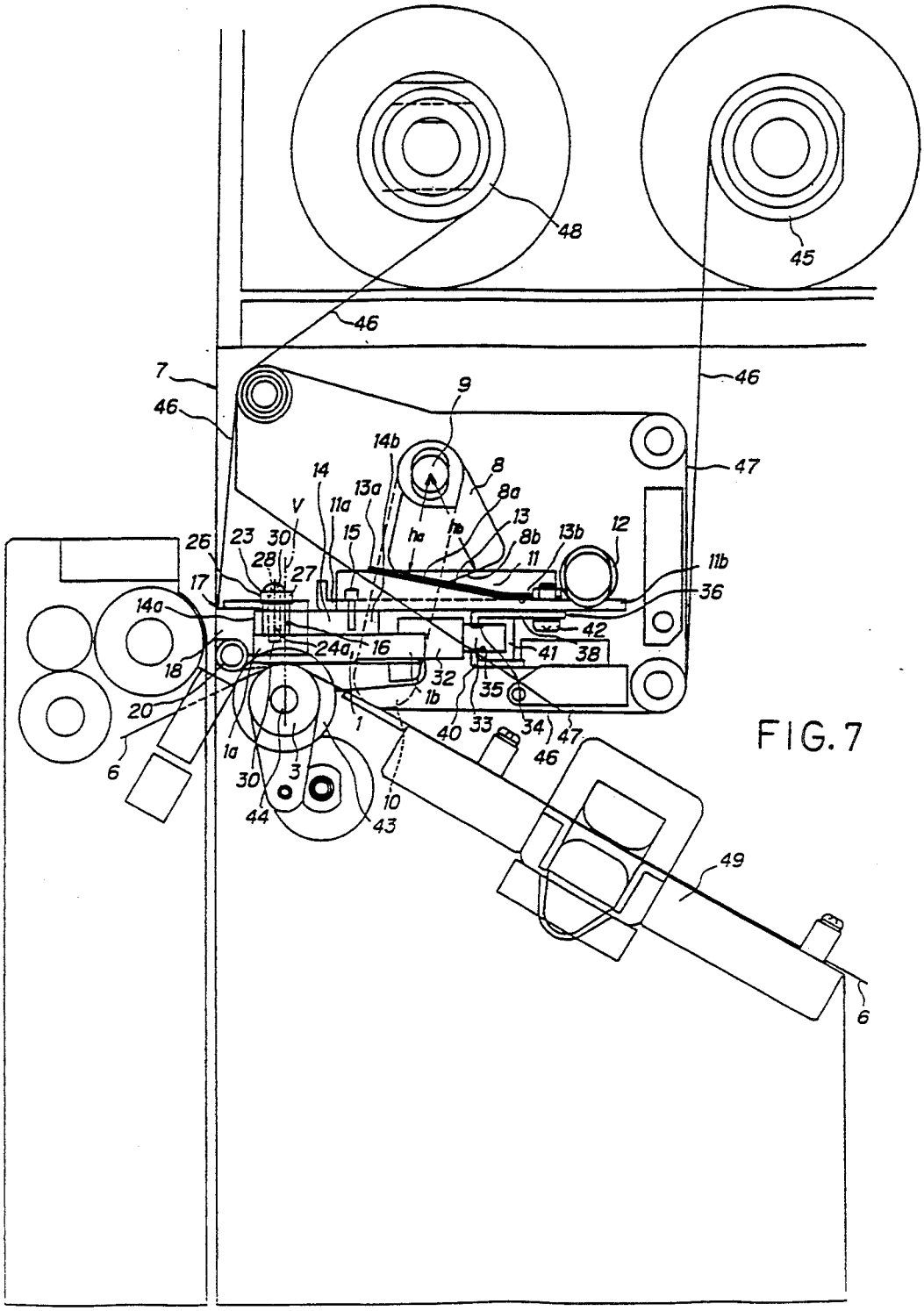
FIG. 7 is a side view showing the principal parts of the apparatus in a position when tags are being printed.
Figure 8A:
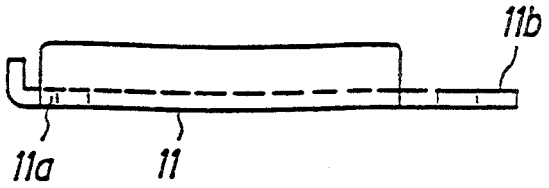
FIG. 8(*a*) is a side view of the head pressing members of the apparatus.
Figure 8B:
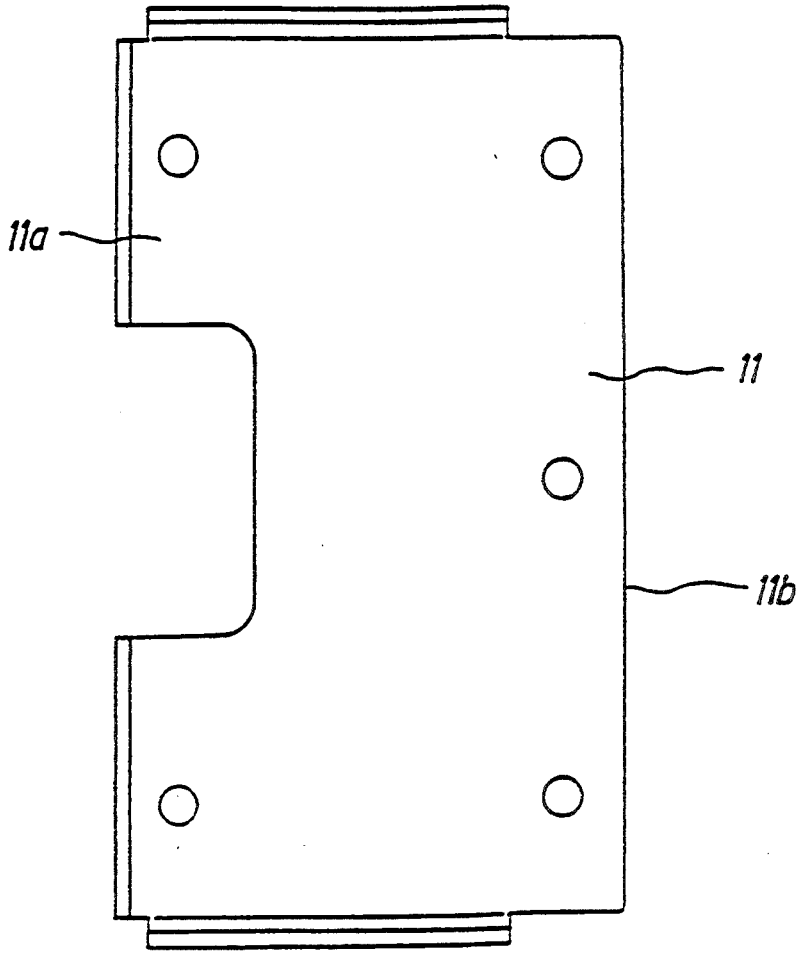
Figure 8C:
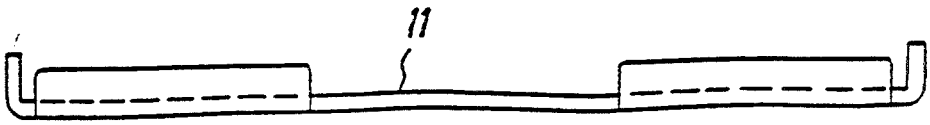

As shown in FIG. 7, a print head pressure positioning cam 8 is affixed to a frame 7 at a prescribed position via a shaft 9, in a way that allows the cam 8 to pivot by a prescribed amount. On the lower part of the positioning cam 8 are a first positioning side 8*a* and a second positioning side 8*b*. The dimension of cam 8 is such that the length "ha" of a perpendicular line from the shaft 9 to the first positioning side 8*a* is slightly shorter than the length "hb" of a perpendicular line from the shaft 9 to the second positioning side 8*b*. A lever 10 on the shaft 9 facilitates pivoting of the positioning cam 8.

A print head pressure member 11 located beneath the positioning cam 8 has a rear portion 11*b* affixed to the frame 7 via a pivot shaft 12 about which the print head pressure member 11 is freely pivotable. A spring (not shown) urges the print head pressure member 11 clockwise. The rear portion 13*b* of a print head pressure-plate spring 13 is attached to the upper surface of the rear portion 11*b* of the print head pressure member 11. From its rear portion 13*b*, the print head pressure-plate spring 13 slopes upward so that its front portion 13*a* is spaced away from the upper surface of the print head pressure member 11. The print head pressure-plate spring 13 is in a position that enables its front portion 13*a* to be brought into contact with the first and second positioning sides 8*a* and 8*b* of the positioning cam 8.

The force exerted on the print head pressure member 11 when the second positioning side 8*b* is in contact with the print head pressure-plate spring 13 is greater than when the first positioning side 8*a* is in contact with the print head pressure-plate spring 13, owing to the fact that the dimension "hb" is greater than the dimension "ha".

Figure 9:
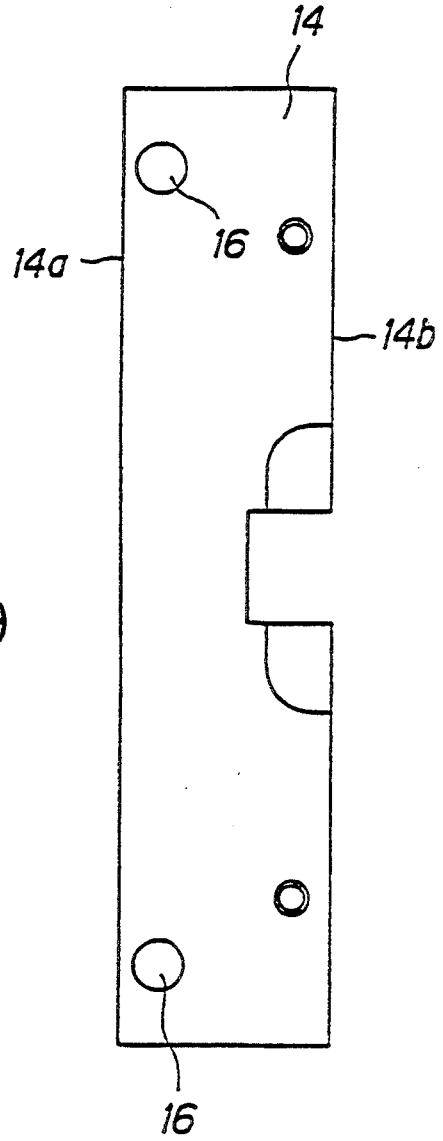
FIG. 9 is a plan view of the head mounting bracket of the apparatus.

A screw 15 attaches the upper surface of the rear portion 14*b* of a head mounting bracket 14 to the lower surface of the front portion 11*a* of the print head pressure member 11. The front portion 14*a* has a pair of rotating member holes 16 (FIG. 9).

Figure 10A:
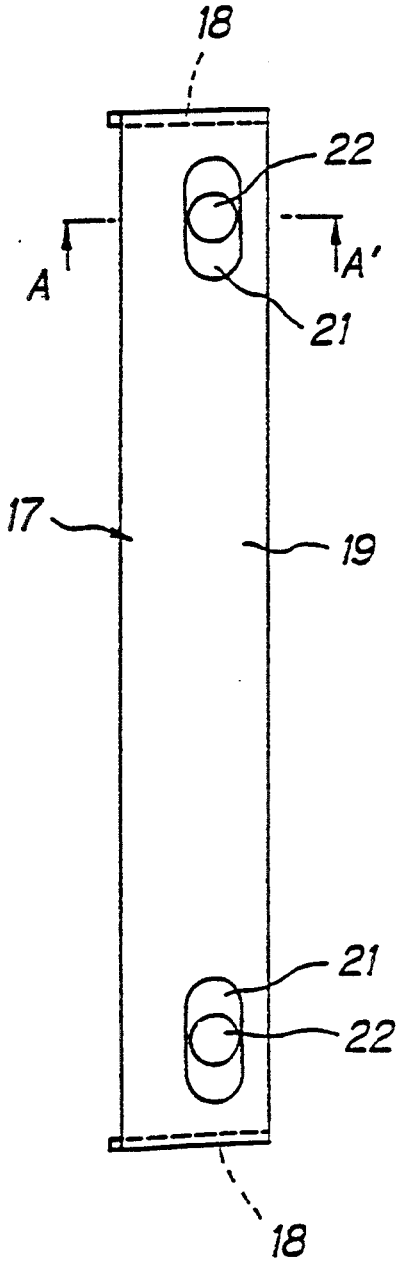
FIG. 10(*a*) is a plan view of the ink ribbon roller guide support frame of the apparatus.
Figure 10B:
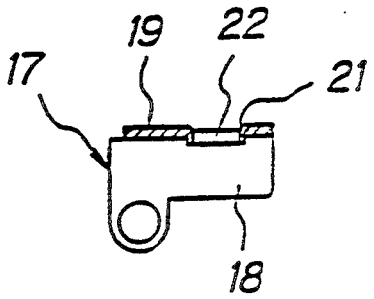
Figure 11A:
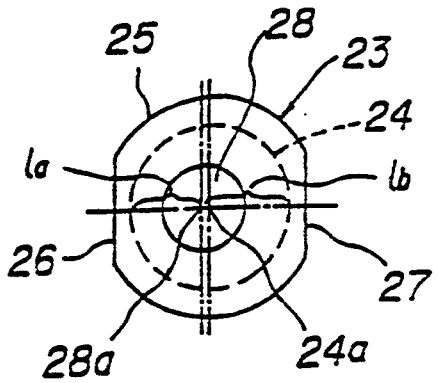
FIG. 11(*a*) is a plan view of the rotatable positioning member of the apparatus.
Figure 11B:
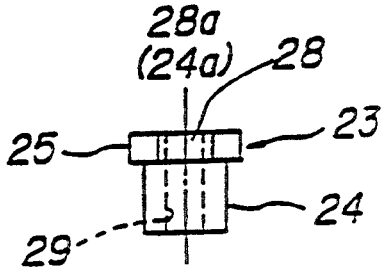

At the front of the head mounting bracket 14 is an ink ribbon guide roller support frame 17 comprised of a pair of side plates 18 joined at their top edges by a connecting portion 19, as shown in FIGS. 10(*a*) and 10(*b*). These side plates 18 are arranged one on each side of the front portion of the head mounting bracket 14, with the lower surface of the connecting portion 19 resting on the upper surface of the front portion 14*a* of the head mounting bracket 14, the holes 22 in the portion 19 being aligned with the holes 16 in the bracket 14. An ink ribbon roller 20 is rotatably mounted between the side plates 18 in contact with an ink ribbon 46. An ellipsoidal depression 21 is provided near each end of the connecting portion 19, the rotating member hole 22 being centrally located therein. Note too that the diameter of the rotating member hole 22 and the rotating member holes 16 in the head mounting bracket 14 are equal. A respective rotatable cylindrical member 24 of the rotation positioning member 23 passes through both holes 16 and 22.

More specifically, each rotation of positioning member 23 (an eccentric screw) is constituted of a cylindrical member 24 having at the top thereof a positioning head 25. Member 23 is capable of being brought into contact with or separated from the depressions 21 in the ink ribbon guide roller support frame 17 and includes a pair of opposed side flats 26 and 27. The diameter of the member 23 is slightly larger than that of the cylindrical member 24. A fixing screw hole 28 is provided along the axis of the positioning head 25. The axis 28*a* of the fixing screw hole 28 is offset by a distance "d" away from the axis 24*a* of the cylindrical member 24, toward the side flat 26. The distance "1*a*" from the central axis 28*a* of the fixing screw hole 28 to the outer surface of the cylindrical member 24 on the flat 26 side is therefore shorter by the distance "d", compared to the distance 1*b* from the central axis 28*a* to the outer surface of the cylindrical member 24 on the side of the flat 27. The distance "d" is selected to set the distance by which the printing element 2 of the thermal print head 1 is movable backwards and forwards.

A fixing screw 30 that is inserted into and through the fixing screw hole 28, and through the interior 29 of the cylindrical member 24, is screwed into position in a screw-hole 31 in the upper surface of the front portion la of the thermal print head 1. The screw 30 serves to secure together the ink ribbon guide roller support frame 17, the head mounting bracket 14 and the thermal print head 1 (FIG. 7).

The thermal print head 1 is equipped with the printing element 2 on the lower surface of the front portion 1*a* thereof, while the rear portion 1*b* is provided with a first connector 32 which can be detachably attached to a second connector 33. Formed in the upper and lower surfaces of the second connector 33 are grooves 34 and 35 of a prescribed length extending along the direction of longitudinal movement of the thermal print head 1 (side to side movement with respect to the perspective of FIG. 7).

Reference numeral 36 denotes a connector support means which supports the second connector 33 in a way that enables the connector 33 to follow the forward and backward movement of the thermal print head 1. The connector support means 36 is constituted by an upper connector support bracket 38 provided with claws 37 at its front portion (FIGS. 14(*a*) and 14(*b*)), a lower connector support bracket 40 provided with claws 39 at its front portion (FIGS. 14(*c*) and 14(*d*)), and a connecting portion 41 which integrally holds the connector support brackets 38 and 40 separated by a prescribed distance. The upper connector support bracket 38 is attached at its rear portion 38*b* to the lower surface of the rear portion 11*b* of the print head pressure member 11 by a screw 42 which permits some vertical and longitudinal motion. The claws 37 and 39 engage with and are movable along the grooves 34 and 35. As the second connector 33 is permanently affixed to the print head pressure member 11 via the connector support means 36, there is no risk of vibration accompanying the operation of the printer which would cause the first connector 32 to come off.

The platen 3 can be moved into and out of contact with the thermal print head 1, with the printing medium 4 therebetween. To print, the platen 3 is driven by a power source (not shown) via a gear 43, causing the platen 3 to rotate counterclockwise (with reference to FIG. 7) about the central axis 44 of the platen shaft.

Reference numeral 45 denotes an ink ribbon supply means 45 which contains a roll of ink ribbon 46. The ink ribbon 46 from the ink ribbon supply means 45 passes along an ink ribbon path 47 to an ink ribbon take-up means 48. A media transport path 49 guides the printing medium 4 between the thermal print head 1 and the platen 3.

The operation of the print head support device of the present invention will now be described, starting with printing of tags 5.

Figure 12A:
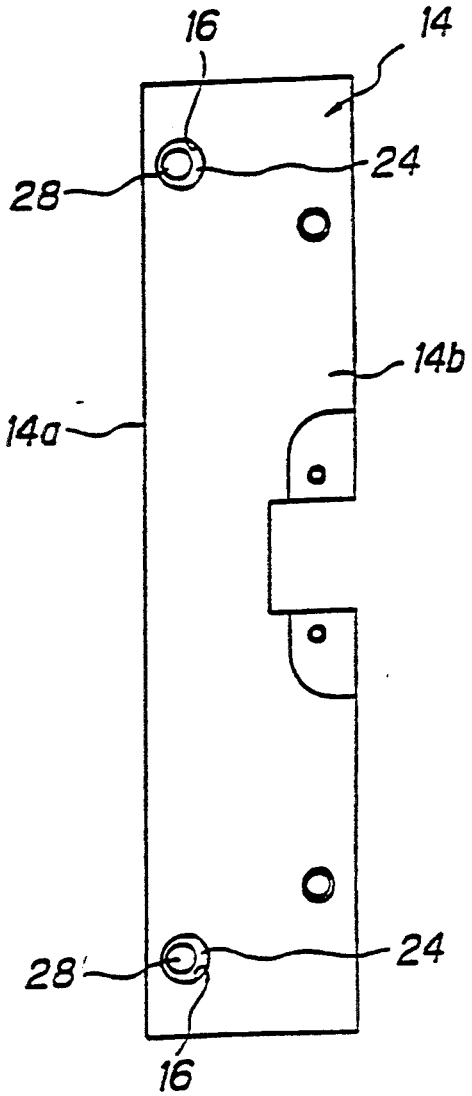
FIG. 12(*a*) shows the underside of the head mounting bracket of the apparatus with the rotatable positioning member with a cutout side thereof located on the front edge of the head bracket.
Figure 12B:
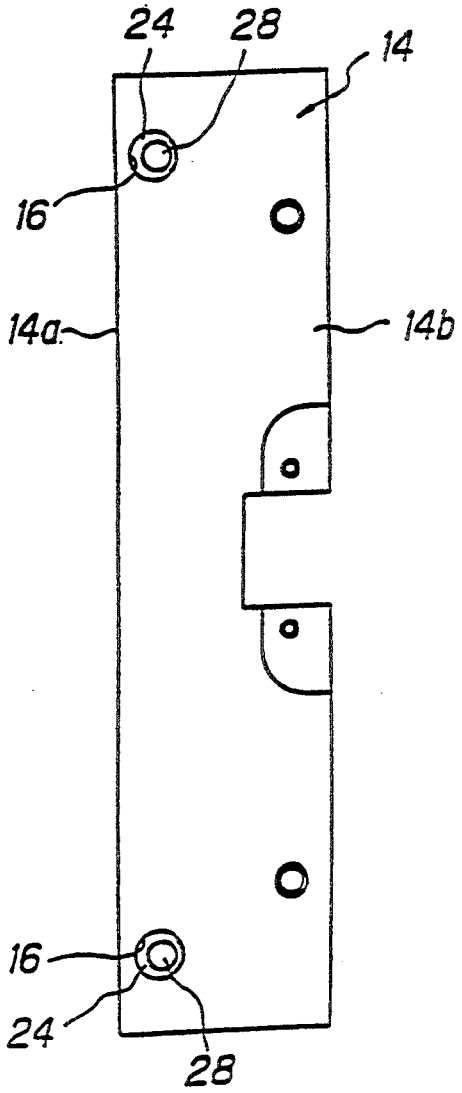
Figure 13:
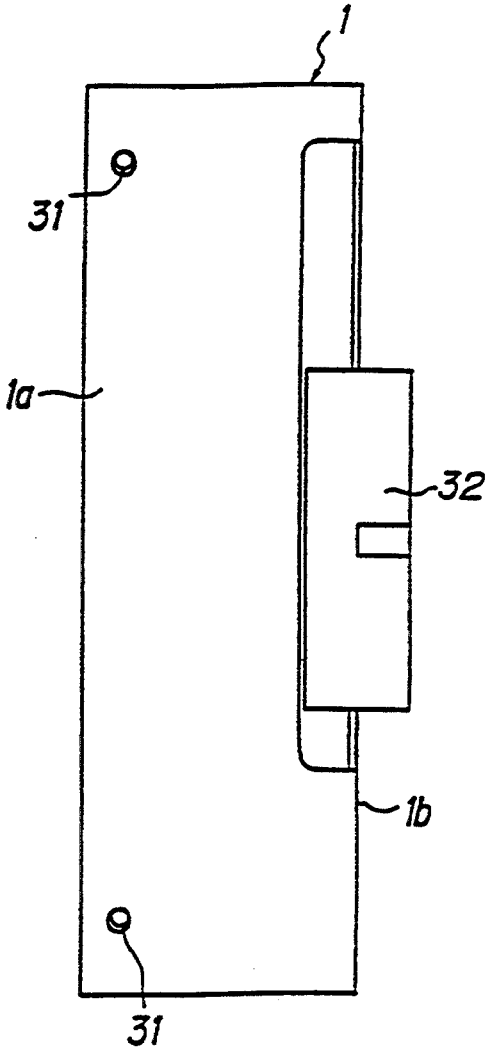
FIG. 13(*a*) is a plan view of the thermal print head of the apparatus.
Figure 13:
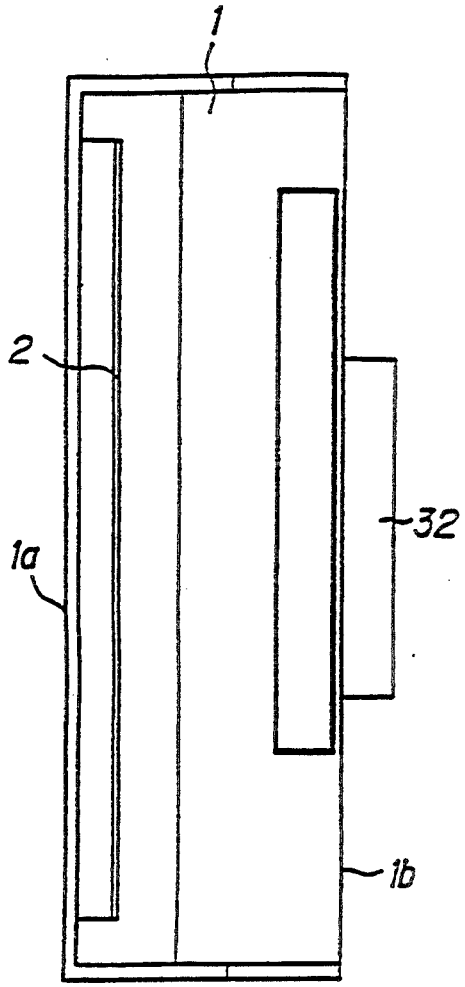
Figure 13:
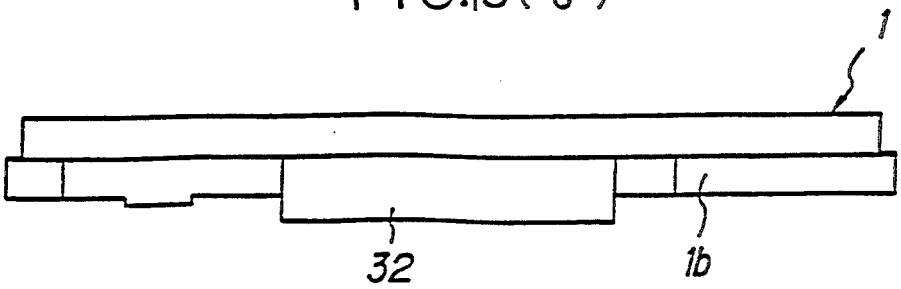
Figure 13D:
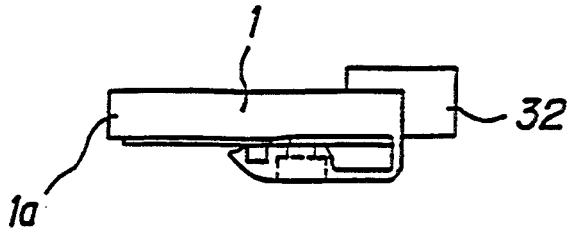
Figure 14A:
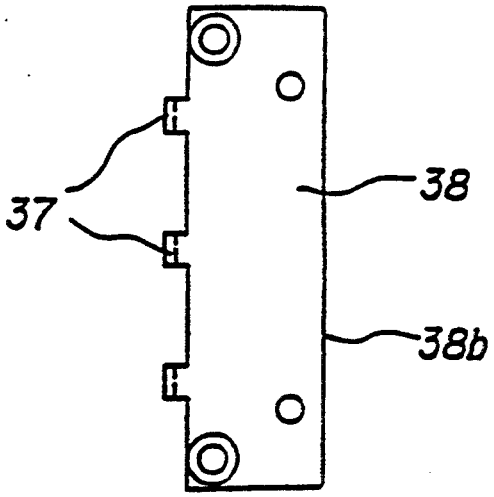
FIG. 14(*a*) is a plan view of the upper connector support bracket.
Figure 14B:
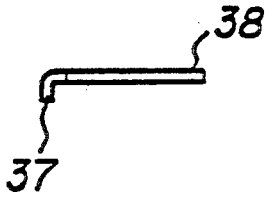
Figure 14C:
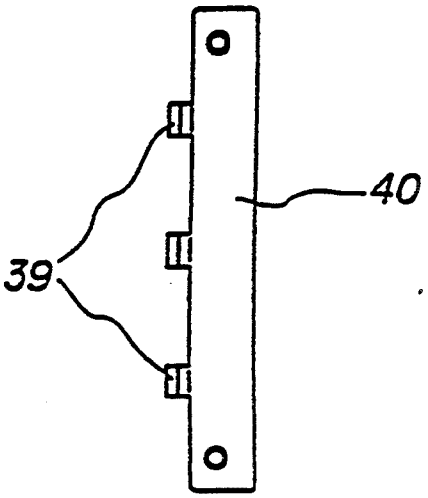
Figure 14D:
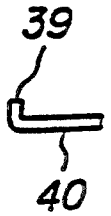

With reference to FIG. 7, the first positioning side 8*a* of the positioning cam 8 is in contact with the print head pressure-plate spring 13 of the print head pressure member 11. This causes the thermal print head 1 to press the ribbon 46 and tag 5 against the platen 3 at a prescribed pressure. Note also that the positioning member 23 is positioned so that the flat 26 faces toward the front of the thermal print head 1 (as shown in FIG. 12(*a*)). The arrangement is such that the distance 1*a* from the central axis 28*a* of the fixing screw hole 28 to the outer surface of the cylindrical member 24 is shorter by the prescribed distance d than the distance 1*b* from the central axis 28*a* of the fixing screw hole 28 to the outer surface of the cylindrical member 24. Therefore, the printing element 2 is positioned slightly to the front of an imaginary perpendicular line V that passes through the platen axis 44. Also, the claws 37 and 39 of the connector support means 36 are at the front end of the grooves 34 and 35 of the second connector 33.

A keyboard (not shown) may now be used to input the necessary commands to cause the platen 3 to rotate forwards and print information on the tags 5 as required. With the printing element 2 positioned slightly to the front relative to the platen axis the printing pressure produced between the printing element 2 and the platen 3 is optimized, resulting in sharp, clear printing on the tags 5.

To print labels 6, the lever 10 is turned counterclockwise whereby the positioning cam 8 is retracted from the print head pressure-plate spring 13. The print head pressure member 11, head mounting bracket 14 and thermal print head 1 will then rotate together clockwise about the pivot shaft 12, retracting the thermal print head 1 from the platen 3.

The fixing screw 30 is thereafter loosened and the positioning member 23 is rotated 180° in the holes 16 and 22 so that the flat 27 faces toward the front of the thermal print head 1, as shown in FIG. 12(*b*). Turning the rotation positioning member 23 180° about the axis 24*a* places the outer wall on the other side of the cylindrical member 24 facing towards the front of the thermal print head 1. At the same time, a central axis 28*a* of the fixing screw hole 26 is rotated by 180 degrees with a radius d about the axis 24*a* of the cylindrical member 24. As a result, the fixing screw 30 in the fixing screw hole 28 is rotated by 180 degrees with a radius d about the axis 24*a* of the cylindrical member 24. Thereby, the screw 30 is shifted to a position that is further backward from the head mounting bracket 14 by the distance 2*d*. As a result, the thermal print head 1 in which the pointed end of the screw 30 is interposed is shifted to a position that is further backward on the head mounting bracket 14 by the distance 2*d*. The claws 37 and 39 of the connector support means 36 shift toward the front of the grooves 34 and 35 of the second connector 33 (this movement will also include longitudinal play, relative to the screw 42, of the nonstationary parts).

Consequently, the printing element 2 is shifted to a position that is further backward on the head mounting bracket 14 by the distance 2*d*, as compared to its position when tags are being printed. The screw 30 is thereafter tightened to lock the ink ribbon guide roller support frame 17, head mounting bracket 14 and thermal print head 1 in position.

A label 6 is then fed between the platen and the print head and the lever 10 is turned clockwise, causing the second positioning side 8*b* of the positioning cam 8 to contact the print head pressure-plate spring 13 and the thermal print head 1 to contact the platen 3 with a predetermined pressure. Also, the printing element 2 moves to a position that is a predetermined distance "2*d*" further backward than when tags are being printed; that is, it contacts the platen 3 at a position that is backward of the imaginary line V.

As before, the keyboard (not shown) is then operated to cause the platen 3 to rotate and the labels 6 to be printed as required. Because at this time the printing element 2 of the thermal print head 1 is located backward of the imaginary perpendicular line V, the printing pressure produced between the printing thermal print head and the labels 6 is optimized, producing optimal print quality. To change back to the tag-printing configuration involves the simple matter of again loosening the screw 30 and turning the rotation positioning member 23 through 180°.

If the positioning cam 8 is turned counterclockwise from the position shown in FIG. 7 so that the first positioning side 8*a* is no longer in contact with the print head pressure-plate spring 13, the print head pressure member 11 will turn clockwise under the urging force until stopped by the boss of the cam 8, just as if thermal print head 1 was being retracted from the platen 3. The screw 15 may then be loosened enabling the structure starting from the head mounting bracket 14 to come free of the print head pressure member 11 and may, depending on the degree of play in the screw 42, end up dangling from the print head pressure member 11. As the connectors 32 and 33 can be detached in this case, worn print heads can be replaced, the positioning can be set for tags or labels, and so forth.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A thermal printer for printing information on printing media of first and second types by pressing a thermal print head against a platen with the printing media located therebetween, the first type of printing media having a relatively high stiffness and the second type having a relatively low stiffness, the thermal printer comprising:

means for supporting the thermal print head; and print head moving means for enabling moving a position of a printing element of the thermal print head forward or backward along a feeding direction of the printing media of the platen in accordance with the type of printing media being used, the printing element being moved in the forward direction for printing media of the first type and being moved in the backward direction for printing media of the second type.

2. A thermal printer, comprising:

means for conveying printing media along a direction of feeding of the thermal printer;

a print head and a platen; and means for adjusting a printing pressure exerted on the platen by the print head to match first and second types of printing media, the first type of printing media having a relatively high stiffness and the second type having a relatively low stiffness, the means for adjusting the printing pressure including means for enabling adjusting a position of a printing element of the print head forward or backward along the direction of feeding of the printing media in accordance with the type of printing media being used, the printing element being moved in the forward direction for printing media of the first type and being moved in the backward direction for printing media of the second type.

3. The thermal printer of claim 2, including a support for the print head, the support comprising a print head pressure member, and securing means for securing the print head pressure member to a frame of the thermal printer.

4. A thermal printer, comprising:

means for conveying printing media along a direction of feeding of the thermal printer;

a print head and a platen;

means for adjusting a printing pressure exerted on the platen by the print head to match different types of printing media, the means for adjusting the printing pressure including means for enabling adjusting a position of a printing element of the print head forward or backward along the direction of feeding of the printing media in accordance with the type of printing media being used; and a support for the print head, the support comprising a print head pressure member, and securing means for securing the print head pressure member to a frame of the thermal printer, the securing means including a pivot enabling the print head pressure member to pivot relative to the frame.

5. A thermal printer, comprising:

means for conveying printing media along a direction of feeding of the thermal printer;

a print head and a platen;

means for adjusting a printing pressure exerted on the platen by the print head to match different types of printing media, the means for adjusting the printing pressure including means for enabling adjusting a position of a printing element of the print head forward or backward along the direction of feeding of the printing media in accordance with the type of printing media being used;

a support for the print head, the support comprising a print head pressure member, and securing means for securing the print head pressure member to a frame of the thermal printer; and a print head pressure positioning cam means for controlling a pressure applied by the print head.

6. The thermal printer of claim 5, wherein the print head pressure positioning cam is pivotably mounted to the frame, the print head pressure positioning cam including first and second pressing sides for applying, respectively, first and second different pressures to the print head.

7. A thermal printer, comprising:

a print head and a platen;

means for adjusting a printing pressure exerted on the platen by the print head to match different types of printing media, the means for adjusting the printing pressure including means for enabling adjusting a position of a printing element of the print head forward or backward along a feeding direction of the printing media;

a support for the print head, the support comprising a print head pressure member, and securing means for securing the print head pressure member to a frame of the thermal printer;

a print head pressure positioning cam means for controlling a pressure applied to the print head;

the print head pressure positioning cam means being pivotably mounted to the frame, the print head pressure positioning cam means including first and second pressing sides for applying, respectively, first and second different pressures to the print head; and a print head pressure plate spring, each of the first and second pressing sides of the cam being positionable to contact the print head pressure plate spring.

8. A thermal printer, comprising:

a print head and a platen;

means for adjusting a printing pressure exerted on the platen to match first and second types of printing media, the first type of printing media having a relatively high stiffness and the second type having a relatively low stiffness, the means for adjusting the printing pressure including means for enabling adjusting a position of a printing element of the print head forward or backward along a feeding direction of the printing media, the printing element being moved in the forward direction for printing media of the first type and being moved in the backward direction for printing media of the second type;

a support for the print head, the support comprising a print head pressure member, and securing means for securing the print head pressure member to a frame of the thermal printer; and a print head mounting bracket secured to the print head pressure member.

9. A thermal printer, comprising:.

a print head and a platen;

means for adjusting a printing pressure exerted on the platen to match different types of printing media, the means for adjusting the printing pressure including means for enabling adjusting a position of a printing element of the print head forward or backward along a feeding direction of the printing media:

a support for the print head, the support comprising a print head pressure member, and securing means for securing the print head pressure member to a frame of the thermal printer;

a print head mounting bracket secured to the print head pressure member; and moving means effective for securing the print head to the print head mounting bracket and for enabling moving the print head in a longitudinal direction relative to the print head mounting bracket.

10. The thermal printer of claim 9, wherein the moving means comprises an eccentric screw.

11. The thermal printer of claim 10, wherein the eccentric screw includes opposed flats disposed at different radial distances from an axis of rotation associated with the eccentric screw.

12. The thermal printer of claim 11, further including a fixing screw for fixing a position of the eccentric screw and the print head.

13. The thermal printer of claim 12, further including a throughgoing hole extending longitudinally of the eccentric screw, the fixing screw being disposed in the throughgoing hole.

14. A thermal printer, comprising:

a print head and a platen;

means for adjusting a printing pressure exerted on the platen to match different types of printing media, the means for adjusting a printing pressure including means for enabling adjusting a position of a printing element of the print head forward or backward along a feeding direction of the printing media;

a support for the print head, the support comprising a print head pressure member, and securing means for securing the print head pressure member to a frame of the thermal printer; and an electrical connector means associated with the print head and effective for enabling moving the print head forward and backward along the feeding direction of the printing media.

15. The thermal printer of claim 14, wherein the electrical connector means comprises grooves formed therein.

16. The thermal printer of claim 15, including claws which engage the grooves and are slidable therein to permit movement of the print head.

* * * * *